United States Patent [19]

Siegfried

[11] 3,955,227

[45] May 11, 1976

[54] FOOTLETS, PANTYHOSE AND PROTECTIVE BAG THEREFOR

[75] Inventor: George Siegfried, Milton, Del.

[73] Assignee: Sklaroff Bros., Inc., Philadelphia, Pa.

[22] Filed: Nov. 14, 1973

[21] Appl. No.: 415,891

Related U.S. Application Data

[63] Continuation-in-part of Ser. No. 341,018, March 14, 1973, Pat. No. 3,906,753.

[52] U.S. Cl. ..... 8/150; 53/21 FC

[51] Int. Cl.[2] ..... D06B 3/30

[58] Field of Search ..... 8/147, 150, 150.5, 159; 68/20, 28, 13 R, 29, 213, 214, 235 R; 53/21 FC, 35, 37; 206/278

[56] References Cited

UNITED STATES PATENTS

| | | | |
|---|---|---|---|
| 2,678,868 | 5/1954 | Drum et al. | 8/150 |
| R25,629 | 8/1964 | Murphy et al. | 8/150 X |

OTHER PUBLICATIONS

Moncrieff, R. W., *Man-Made Fibers*, N.Y., John Wiley & Sons, Inc., 1970, pp. 578–579.

*Primary Examiner*—Philip R. Coe

*Attorney, Agent, or Firm*—Caesar, Rivise, Bernstein & Cohen, Ltd.

[57] ABSTRACT

Knitted articles, such as footlets, pantyhose and washing bags are provided, each includes a beaded portion forming the top thereof and a body portion connected to the beaded portion. The beaded portion is formed of a plurality of alternate and intermediate courses of Lycra yarn. The intermediate courses comprise a predetermined number of loops and the alternate course comprises a fraction of said predetermined number of loops. The alternate and intermediate courses alternate through the beaded portion starting with an alternate course. The body portion is knitted of a hosiery yarn and includes a plurality of courses, each of which includes the predetermined number of loops.

The footlets and pantyhose once knitted in greige are inserted in a greige knitted bag and are dyed therein. The combination of the bag with the footlets or pantyhose therein is thereafter packaged for subsequent sale of the combination.

2 Claims, 5 Drawing Figures

FOOTLETS, PANTYHOSE AND PROTECTIVE BAG THEREFOR

This application is a Continuation-in-Part of U.S. Pat. application Ser. No. 341,018, filed on Mar. 14, 1973, and now Pat. No. 3,906,753, whose disclosure is incorporated by reference herein.

This invention relates generally to knitted articles and more particularly to footlets, pantyhose and knitted bags therefor as well as a method for producing the same.

Prior to the invention as set forth in the above noted application, knitted hosiery such as footlets and pantyhose suffered from various disadvantages and there existed a need for knitted footlets which could be readily and economically manufactured, could be fit on a variety of foot sizes, would roll up nor slide down the wearer's foot, while being attractive and unobtrusive in appearance. The invention as shown and claimed in the above entitled application achieves those ends and overcome the disadvantages of the prior art by providing novel footlets, pantyhose and washing bags therefor. Each article is knitted and includes a beaded portion forming the top thereof, a banded portion connected to the beaded portion and a body portion connected to the banded portion. The beaded portion is formed of a plurality of alternate and intermediate courses of elastic yarn, such as Lycra. The intermediate courses comprise a predetermined number of loops whereas the alternate courses comprise a fraction of said predetermined number of loops. The alternate and intermediate courses alternate throughout the beaded portion, starting with an alternate course. The banded portion of the article is formed of a larger plurality of alternate and intermediate courses which alternate throughout, starting with an alternate course. The alternate and intermediate courses of the banded portion are formed of hosiery yarn, such as Nylon. The body portion of the article is also knitted of Nylon yarn and includes a plurality of courses, each of which includes the predetermined number of loops.

It has been found that the banded portion of the footlets, pantyhose and washing bags therefor formed in accordance with the teachings of the aforementioned patent can be eliminated to thereby simplify the knitting operation, while still providing knitted articles which do not roll up on the user, are not bulky and uncomfortable, yet are attractive in appearance.

Accordingly, it is a general object of this invention to provide knitted articles, such as footlets, pantyhose and washing bags therefor which overcome various disadvantages of the prior art.

It is a further object of this invention to provide footlets, pantyhose and washing bags therefor which can be readily knitted and which overcome various disadvantages of the prior art.

It is a common practice in the hosiery industry to place uncolored or griege knitted articles, such as pantyhose, on patterns or boards to shape the articles. The "boarding" of hosiery ensures that the hosiery will be flat or smooth even when relaxed. After the articles are boarded, they are inserted in a dye bath to impart the desired color to the hosiery. Once the colored hose has dried, it is removed from the board, is folded and thereafter packaged for subsequent sale. The above described operations are time consuming and hence wasteful, particularly since the buying public no longer places the high premium on the smooth relaxed appearance of boarded hosiery.

As an alternative to boarding hosiery, knitted articles have been dyed in the natural or wrinkled state which they are in after knitted and assembled. To that end, knitted fabric bags, such as shown in U.S. Pat. No. 3,331,221 (Lawson, Jr.) have been used to hold the greige pantyhose therein for immersion in a dye bath. The knitted bags are adapted to hold a plurality of knitted articles therein and are formed of a material such as polypropylene so as to be impervious to the dye of the dye bath.

The dye bag method of coloring hosiery, while more efficient than the dyeing of boarded hosiery, nevertheless is still time consuming and wasteful since a relatively large amount of time is required to insert the hosiery within the bag and to remove the hosiery from the bag once the hosiery has been dyed.

Accordingly, it is a further object of this invention to provide a method of producing hosiery and laundering bags therefor which is simpler and less time consuming than prior art methods.

These and other objects of this invention are achieved by providing a knitted article comprising a beaded portion forming a top thereof and a body portion connected to the beaded portion. The beaded portion consists of a first plurality of alternate and intermediate courses of a first yarn. Each of the intermediate courses comprises a predetermined number of loops whereas each of the alternate courses comprise a fraction of said predetermined number of loops. The courses of the beaded portion alternate throughout the beaded portion starting with an alternate course. The body portion comprises a plurality of courses of a second yarn and each of the courses includes the said predetermined number of loops.

Other objects of the invention are achieved by providing a method of producing knitted articles for subsequent packaging and sale, the articles comprising a colored knitted pantyhose or footlet disposed within a correspondingly colored and knitted bag. The method comprises the steps of knitting the pantyhose of footlet in greige, knitting the bag in greige, inserting the greige pantyhose or footlet within the greige bag and thereafter dyeing the combination with the pantyhose or footlet within the bag.

Other objects and many of the attendant advantages of this invention will be readily appreciated as the same becomes better understood by reference to the following detailed description when considered in connection with the accompanying drawings wherein.

Figure 1:
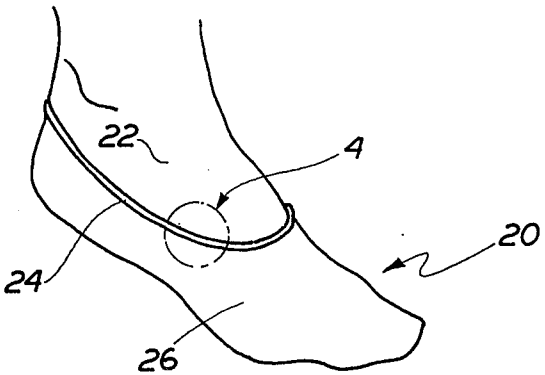
FIG. 1 is a perspective view of a footlet in accordance with one aspect of this invention.

Referring now in greater detail to the various figures of the drawing wherein like reference characters refer to like parts, a knitted footlet embodying one aspect of the invention is shown generally at 20 in FIG. 1. This figure shows the manner in which the footlet is worn on one's foot 22.

As can be seen, the knitted footlet 20 basically comprises an elastic beaded portion 24 forming an opening therein and a tubular body portion 26 connected to the beaded portion and joined along its bottom edge as by sewing.

As is known, footlets are utilized to provide a covering on the foot such that one's foot does not directly contact the interior of one's shoe, thereby increasing shoe comfort. In addition, the footlet serves to absorb foot perspiration there by further increasing comfort.

The elastic beaded portion of the footlet serves to support the footlet comfortably on the wearer's foot without binding while precluding the footlet from rolling down.

In accordance with one aspect of this invention, the elastic portion 22 of the footlet 20 is knitted from an elastic yarn such as Lycra and consists of a small number of courses so as to be virtually unnoticeable when worn.

Figure 2:
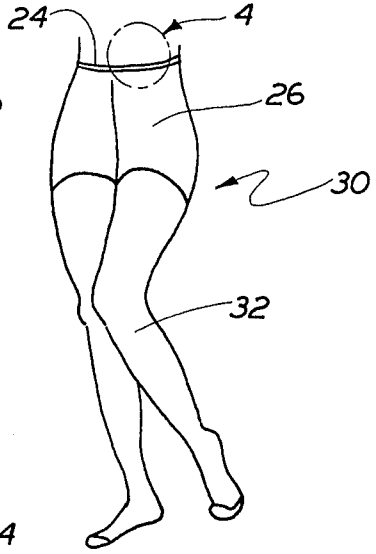
FIG. 2 is a perspective view of a pantyhose in accordance with one aspect of this invention.
Figure 3:
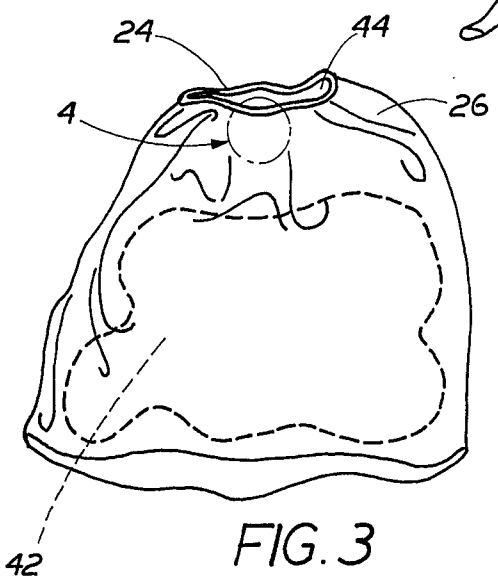
FIG. 3 is a perspective view of a delicate garment storage and washing bag in accordance with one aspect of this invention.

Referring now to FIG. 2, a knitted pantyhose embodying one aspect of this invention is shown generally at 30 therein. The pantyhose 30 is adapted to be worn on one's legs 32 and lower torso.

As can be seen, the knitted pantyhose 30 basically comprise an elastic beaded portion 22 forming an opening therein and a body portion including a lower torso receiving section and a pair of leg sections depending therefrom.

Like the beaded portion 24 of footlet 20, the beaded portion 24 of pantyhose 30 serves as the means for supporting the footlet comfortably in place on the wearer and without binding.

Figure 4:
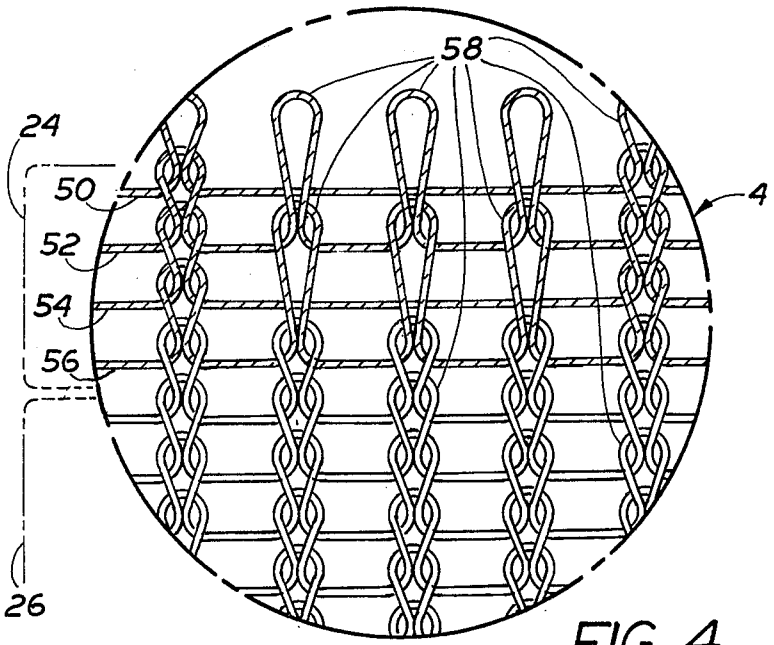
FIG. 4 is a greatly enlarged view of the area denoted by the numeral 4 in FIGS. 1, 2 and 3 showing the knitting pattern of one aspect of this invention.

Referring now to FIG. 4 there is shown a knitted protective bag for storing, washing and drying delicate fabric garments, like that designated by the reference numeral 42, therein. The bag is closed at its bottom and includes an opening 44 through which the garments 42 may be inserted in or removed from the bag.

As can be seen, the bag basically comprises a beaded portion 24 which forms the opening 44 and a body portion 26 connected to the beaded portion.

Like the beaded portions 24 of the footlet 20 and pantyhose 30, the beaded portion 24 of the washing bag 40 is elastic. The elastic beaded portion serves to close the bag to preclude garments disposed therein from falling out of the bag. In accordance with one aspect of this invention, the beaded portion 24 of the articles 20, 30 and 40 include a plurality of alternate and intermediate courses. The first course of the beaded portion 24 is hereinafter referred to as an alternate course and is knitted utilizing a first predetermined number of needles of a knitting machine in order to form a first predetermined number of stitches or loops in that course. The immediately succeeding course, hereinafter called the inermediate course, is knitted utilizing a second predetermined number of needles of the knitting machine to form a second predetermined number of loops in the course. The number of loops in each alternate course is a fraction of the number of loops in each intermediate course and is established in accordance with the type of article desired. The remainder of the beaded portion consists of alternate and intermediate courses alternating throughout starting with an alternate course.

In accordance with the preferred embodiment, the beaded portion preferably includes a total of from four to eight courses, depending upon the type of article desired, but may in some cases, include fewer or greater courses.

In FIG. 4 there is shown within area 4 a portion of the beaded portion 24 and body portion 26 of each of the articles 20, 30 and 40. The beaded portion 24 comprises a total of 4 courses, namely, 50, 52, 54 and 56. Courses 50 and 54 form the alternate courses and courses 52 and 56 form the intermediate courses. Each of the courses include a plurality of loops 58 therein. As can be seen, for a given length of the beaded portion 24, the alternate courses 50 and 54 include half the number of loops 58 as do the intermediate courses 52 and 56.

The intermediate courses are knit utilizing all of the needles of the knitting machine, e.g. 400 needles, whereas the alternate courses are knit utilizing every fourth needle of the knitting machine. This results in three intermediate course loops being disposed between adjacent alternate course loops.

All of the alternate and intermediate courses of the beaded portion 24 are knitted of an elastic yarn such as 140 denier Lycra. Preferably, the lycra is applied under tension to the needles of the knitting machine making the article so as to extend the length of the elastic yarn during the knitting operation. Once the stitches or loops of the beaded portion are formed, the elastic yarn returns to its original state, thereby reducing the circumference of the beaded portion. Because the elastic yarn is knitted under tension and because the alternate courses of the beaded portion have fewer loops than the intermediate courses thereof, the beaded portion 24 contracts a great deal when relaxed. This action aids the bead in holding the article up and also causes the top selvage to stand up, thereby precluding it from rolling.

Once the beaded portion 24 is completed, the body portion 26 is knitted. In accordance with the preferred embodiment of the invention, the body portion is knitted of a hosiery yarn such as Nylon. Nylon yarn is slightly elastic although not nearly as elastic as Lycra.

The body portion 26 comprises a large number of courses, the number depending upon the type of article. As can be seen in FIG. 4, only the first four courses of the body portion 26 are shown, namely, courses 60, 62, 64 and 66. Each course includes the same number of loops 58 as the intermediate courses of the beaded portion 24 and in this regard all the courses of the body portion may be considered to be intermediate courses.

The alternate courses of the embodiment shown in FIG. 4 have one-fourth the number of loops as the intermediate courses to ensure that the diameter of the bead or opening in the article shrinks greatly when relaxed for a highly elastic effect. This feature is of considerable importance insofar as bags are concerned since a small opening precludes articles disposed within the bag from falling out of the bag. Insofar as footlets and pantyhose are concerned, particularly effective beaded portions comprise alternate courses having one-half the number of loops as the intermediate courses. This latter arrangement ensures that the beaded portion does not shrink greatly which action may bind or cut into the wearer.

In accordance with another aspect of this invention, there is provided a novel method of producing a dyed, knitted fabric garment, such as a footlet or pantyhose, and a correspondingly dyed, knitted washing and storage bag for such a garment. The method is simple and economical and requires significantly less manipulative operations from the time that the garment and the bag therefor are assembled in their greige state until their final packaging for sale, than prior art production methods.

Figure 5:
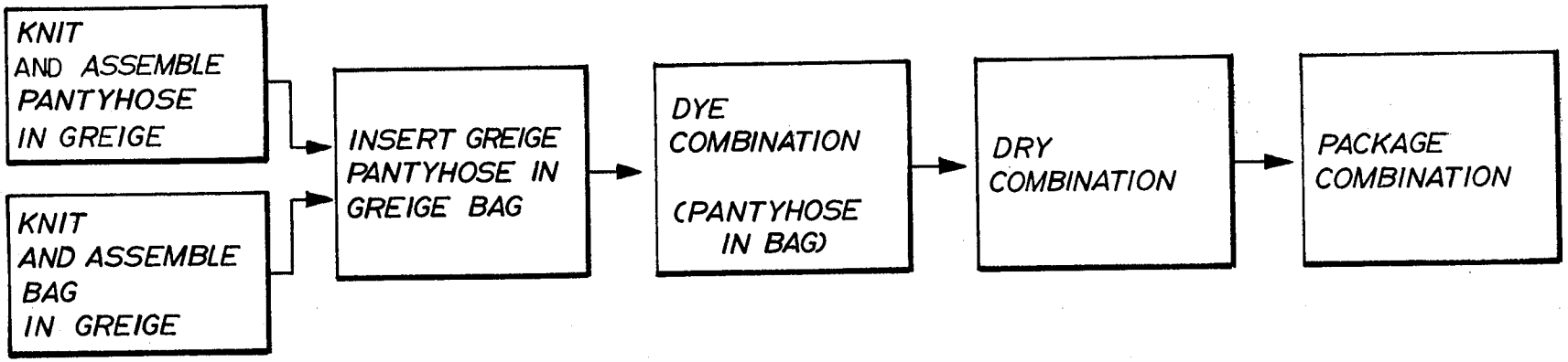
FIG. 5 is a functional block diagram of the method of producing knitted articles for sale.

The method of this invention is shown in the functional block diagram of FIG. 5. As can be seen, the method comprises the steps of knitting and assembling the garment in its greige state and knitting and assembling the washing and storage bag therefor in its greige state, inserting the greige garment in the greige bag, dyeing the garment within the bag, drying the combination of the garment within the bag and thereafter packaging the combination with the garment still disposed within the bag.

It should be noted that in accordance with the method of this invention, the knitting and assembling of the greige garment in the greige bag can be accomplished either contemporaneously one can be knitted and assembled either prior to or subsequent to the knitting and assembling of the other.

As will be appreciated by those skilled in the art, by dyeing the garment within the bag and subsequently packaging the combination with the garment still within the bag, there is no need for the various time consuming operations inherent in the prior art, e.g. removing dyed garments from a common dyeing bag and thereafter individually packaging the garments. This feature is of considerable importance from the standpoint of manufacturing economics. In addition, the packaged-for-sale end product of this invention, not only includes the garment but also includes an identically colored washing and storage bag therefor, a product that has significant sales appeal in the highly competitive hosiery industry.

A typical example of the method of this invention is as follows: After inspection of the assembled garment, the garment is placed in a knitted bag like those in accordance with this invention. The insertion of the garment in the bag can be carried out manually or automatically. The bag is put into a dye tub such as a four pocket rotary tub and the tub is then filled with water to an appropriate level, e.g. the axis. The temperature of the water is then raised to about 120° F. and a predetermined amount, e.g. 1% by weight of the goods, of a scouring solution such as Brosco or Alo is added. The tub is rotated to agitate the goods for 15 minutes. The scouring solution is drained and the tub refilled with cold water and run for 5 to 10 minutes to rinse the goods. The rinse water is then drained and the tub is refilled. The water temperature is then raised to 100° and 5 to 6% of a leveling agent such as Trimine DR is added. The tub goods are then agitated for about 10 minutes to assure proper exposure of all of the fabric to the leveling agent. Disperse dyes are then inserted in the tub, the formula and concentration thereof being predetermined to achieve the desired shade of coloration. The water temperature is thereafter raised very slowly to 140°–150° F. and the articles are agitated at this temperature for approximately 45 minutes. Once the goods have achieved the desired shade the dye bath is drained and the goods are thereafter rinsed for 5 to 10 minutes in cold water. The rinsed goods are then taken out of the dye tub and placed in an extractor and spun damp dry. The goods are thereafter removed from the extractor and placed in drying tumblers and tumbled dry. The dry articles are then available for packaging in any type of package such as conventional cellophane bags.

Without further elaboration the foregoing will so fully illustrate my invention that others may, by applying current or future knowledge, readily adapt the same for use under various conditions of service.

What is claimed as the invention is:

1. The method of producing a knitted combination article for subsequent packaging and sale as a unit, said article comprising a dyed, knitted garment disposed within a correspondingly colored dyed knitted bag, said bag serving as protective and laundering bag for said garment, the method comprising placing a greige knitted garment within a greige knitted bag, dyeing the combination with the garment in the bag so that the garment and the bag take on a corresponding color, and thereafter drying the combination with the garment still within the bag.

2. The method of producing a packaged knitted combination article, said article comprising a dyed knitted garment disposed within a correspondingly colored dyed knitted bag, said bag serving as a protective and laundering bag for said garment, the method comprising placing a greige knitted garment within a greige knitted bag, the knitting pattern of the bag being similar to the knitting pattern of the garment, dyeing the greige garment while within the greige bag, so that the garment and bag are of a corresponding color, drying the dyed bag and correspondingly colored dyed garment disposed therein and thereafter packaging the combination with the garment still disposed within the bag.

* * * * *